United States Patent [19]

Adams

[11] Patent Number: 4,493,736

[45] Date of Patent: Jan. 15, 1985

[54] TARNISH-RESISTANT COPPER ALLOY AND METHOD OF PREPARATION

[75] Inventor: William R. Adams, Hampden, Mass.

[73] Assignee: Trindium Corporation of America, Sauquoit, N.Y.

[21] Appl. No.: 538,806

[22] Filed: Oct. 5, 1983

[51] Int. Cl.[3] ..... C22C 9/01; C22F 1/08

[52] U.S. Cl. ..... 148/2; 148/11.5 C; 420/486; 420/489

[58] Field of Search ..... 420/485, 489, 486, 487, 420/488, 471, 473, 479; 148/2, 11.5 C, 12.7 C, 435, 436, 414

[56] References Cited

U.S. PATENT DOCUMENTS 3,958,322 5/1976 Rhodes ..... 29/527.6

3,998,633 12/1976 Rhodes ..... 420/489

*Primary Examiner*—Peter K. Skiff

*Attorney, Agent, or Firm*—Kane, Dalsimer, Kane, Sullivan and Kurucz

[57] ABSTRACT

An alloy of copper, aluminum, nickel and indium is found useful in the fabrication of jewelry and dental appliances. The alloy resists tarnishing and has a gold-like appearance.

2 Claims, No Drawings

TARNISH-RESISTANT COPPER ALLOY AND METHOD OF PREPARATION

BACKGROUND OF THE INVENTION

1. Field of the Invention

The invention relates to alloys having many desirable characteristics of gold, and more particularly relates to an alloy of copper, aluminum, nickel, indium and other metals which is resistant to tarnishing.

2. Brief Description of the Prior Art

The literature is replete with descriptions of alloys of copper and other metals. Representative of such descriptions are those found in the U.S. Pat. Nos. 1,651,970; 3,091,527; and 3,998,633.

The U.S. Pat. No. 3,998,633 contains a recital of the prior art problems associated with aluminum/copper alloys and their use as substitutes for gold in jewelry, etc. As related therein, aluminum/copper alloys alone are not satisfactory because when cast they result in a "woody grain structure". To overcome this disadvantage, resort had been made to the inclusion of a wide variety of other metals, including nickel. However, it was reported that the inclusion of these ancillary metals, including nickel in the aluminum/copper alloys was unsatisfactory. The resulting alloys possessed inferior color complexion and developed a tarnish over a period of time which was not unlike the tarnish associated with common bronzes. Additionally, it was reported, the alloys were difficult to solder, and did not buff or polish in a satisfactory manner to obtain a gold-like appearance. The U.S. Pat. No. 3,998,633 then teaches that indium may be included in aluminum/copper alloys to improve the difficulty in casting of the bronzes, without all of the disadvantages associated with the use of the prior art metal additives such as nickel.

However, the alloys of aluminum and copper containing indium alone still tarnish to an undesirable degree. In addition, their ductility is not fully amenable to hot-rolling and finishing.

I have found that the prior art problems associated with the presence of nickel in aluminum/copper alloys do not exist, when indium is included as an alloy ingredient. This is unexpected, and permits one to include the nickel, known to improve hot-rolling and cold drawing of the copper/aluminum alloys.

In addition, the preferred method of preparing the alloys of the invention enhance their resistance to tarnishing.

SUMMARY OF THE INVENTION

The invention comprises an alloy, which consists essentially of:

(a) from about 9 to about 11 percent by weight of aluminum;

(b) from about 0.75 to about 1.25 percent by weight of nickel;

(c) from about 0.01 to about 0.1 percent by weight of indium; and (d) from about 87.65 to about 90.24 percent by weight of copper.

The alloys of the invention have the appearance of gold and are useful in the fabrication of jewelry, dental appliances and like uses. They are non-toxic, corrosion resistant to a wide variety of corrosives and readily worked, soldered etc.

The invention also comprises a method of alloying copper, aluminum, nickel and indium to enhance the tarnish resistance of the alloy, which comprises;

(1) providing a melt of the nickel and a portion of the copper;

(2) adding the aluminum and indium to the molten mixture of copper and nickel, said aluminum being in the form of an alloy with the remainder of the copper;

(3) thoroughly melting the mixture of (2) above;

(4) cooling the melt (3) to solidify; and (5) hot-rolling the solid to reduce its thickness to from 1/7 to 1/18 of its original thickness.

DETAILED DESCRIPTION OF THE PREFERRED EMBODIMENTS OF THE INVENTION

The alloys of the invention may be prepared by preparing a molten mixture of the copper, nickel, aluminum and indium. When thoroughly mixed, the molten mixture is allowed to cool to solidify. The solidified alloy may then be processed in conventional and known manner to finish the alloy for use. For example, the alloy may be re-cast, drawn, hot-pressed etc. The alloy may be buffed, coated, soldered, etc.

The method of preparing the alloy of the invention is critical. The copper is melted and the nickel dissolved therein. Alternatively, the copper and nickel ingredients may be charged and melted together in an appropriate vessel. The indium may be added to the resulting mixture of molten copper and nickel, or after the addition of the aluminum. The aluminum is added to the molten mixture of copper and nickel and is melted and dissolved therein (aluminum being soluble in molten copper) in the form of a copper/aluminum master alloy. If one melts the aluminum in the copper without the presence of the molten nickel, the color of the desired alloy will not be gold-like but will instead be a brown color. If one melts the aluminum in the melt of copper/-nickel alone, i.e., not in the form of an aluminum/copper master alloy, the optimum tarnish resistance is not obtained. Hence the order of alloying the metal ingredients is critical. Most preferably some of the copper is pre-mixed with the aluminum, and added as a 50/50 copper/aluminum master alloy. In general, such a master alloy may be used in a proportion sufficient to provide all of the aluminum ingredient. The melt temperatures of the ingredients making up the alloy compositions of the invention are well known. The technique of melting may be conventional, although conductive melting is preferred over crucible melting.

The final step in the preferred method of the invention is a hot-rolling of cast ingots to reduce their thickness. The techniques of hot-rolling are well known to those skilled in the art and details need not be recited herein. Hot-rolling to from 1/7 to 1/18 of the original ingot thickness appears to affect the crystallinity of the final product.

The following examples describe the manner and the process of making and using the invention and set forth the best mode contemplated by the inventor for carrying out the invention.

EXAMPLE 1

A casting was made from a melt of alloy ingredients made in an induction melting furnace. The charge consisted of the following elements:

| | |
|---|---|
| 400 lbs. | Aluminum |
| 40 lbs. | Nickel |
| 6 lbs. | Indium |
| 3554 lbs. | Copper |

Procedure

The 40 lbs. of nickel was charged with 2262 lbs. of copper and a charcoal cover was added to the melt. The charge was brought to the molten stage and then the 400 lbs. of aluminum was added in the form of a 50% copper/aluminum master alloy. This addition added 1292 lbs. of copper to the melt. Following the aluminum addition, 6 lbs. of Indium was added to the melt. The temperature of the melt was increased to 2200° F., and the two rolling ingots were cast in still molds. The resulting rolling ingots were 7" thick×21" wide×42" long.

The rolling ingots were overhauled and hot rolled at 1700° F. to 0.062" gauge sheet. The resultant sheet was buffed, slit to final width, and then blanked into ½"×½×0.062" squares.

The actual composition is listed below and compared with the desired range and the nominal analysis.

| Element | Desired Range | Nominal | Actual |
|---|---|---|---|
| Aluminum | 9% -11% | 10% | 9.82% |
| Nickel | 0.75%-1.25% | 1% | 1.18% |
| Indium | Trace | Trace | 0.025% |
| Copper | Balance | | 88.66% |
| Remainder: | Si - 0.028, Fe - 0.08, Zn - 0.16, Sn - 0.015, Pb - 0.006, Mn - 0.026 | | 0.015% |

The squares are readily melted, exhibit no porosity, polish to a gold-like finish. The alloy solders well with a standard solder.

After buffing, representative squares were subjected to an accelerated corrosion test by immersion in 100 ml. of a variety of corrosive fluids. After 10 days of immersion, the weight loss experienced was determined and changes in color recorded. The test results are set forth in the following Table.

| | CHANGE IN COLOR | % LOSS IN WEIGHT |
|---|---|---|
| CORROSION MEDIA | | |
| 50% nitric acid | Dark Brown | 0540 |
| Sol. of Sodium-hydroxide | None | None |
| Sol. of Sodium-carbonate | | None |
| Sol. of Ammonia Water | Light Brownish Green | None |
| Saturated sol of | | |
| Calcium-chloride | White precipitate | 1.0178 |
| Sodium-chloride | Green precipitate | .0646 |
| Sodium-sulphite | Green-White precipitate | .0441 |
| Sodium-nitrate | | |
| Sod. chlorate & Sod. nitrate | | |
| Sod. phosphate & Sod. bicarbonate | None | None |
| Sod. citrate & Sod. tartrate | Slight darkening | None |
| 50% solutions of organic acids | | |
| Acetic | None | Nil |
| Citric | None | Nil |

-continued

| | CHANGE IN COLOR | % LOSS IN WEIGHT |
|---|---|---|
| Malic | None | Nil |
| Lactic | None | Nil |
| Conc. Oleic | None | Nil |
| Saturated solutions of gasses | | |
| Carbon dioxide | Slight darkening | None |
| Hydrogen sulphide | Slight darkening, no etching | Nil |
| Sulphide dioxide | None | Nil |
| Mineral acids | | |
| Sulfuric (50% solution) | None | .0045 |
| Hydrochloric (37% solution) | Deep etching | 3.1447 |

Representative squares were also left exposed to the atmosphere for a period of four weeks. No tarnishing was observed during this period.

EXAMPLE 2

The following is a comparative example of the invention.

The following ingredients were alloyed together.

| | |
|---|---|
| 0.3 lb. | Copper/Nickel Alloy 706 |
| 0.3 lb. | Aluminum Alloy 1100 |
| 2 grams | Indium |
| 2.4 lbs. | Copper |

Procedure

The 0.3 lbs. of copper nickel alloy and the 2.4 lbs. of copper were charged into a graphite crucible, a charcoal cover was added to prevent oxidation, then the crucible was placed in an electric muffle oven and brought up to the melting point, approximately 1917° F. After complete melt down, the 0.3 lbs. of aluminum was added and the melt was stirred to mix the molten constituents. The final addition was the 2 grams of Indium. The temperature was raised to 2150°-2200° F. to insure completion of alloy formation. The crucible was then removed from the furnace, stirred and allowed to air cool to complete solidification of the alloy.

The resultant casting was overhauled, samples taken for analysis, and hot rolled at 1700° F. down to ⅛" gauge. Samples of the hot rolled casting were buffed to bring out the fold color of the alloy. The desired range and the nominal range as well as the actual composition of the casting is shown below.

| Element | Desired Range | Nominal | Actual |
|---|---|---|---|
| Aluminum | 9%-11% | 10% | 10.4% |
| Nickel | 0.75%-1.25% | 1% | 1.0% |
| Indium | Trace | Trace | 0.10% |
| Copper | Balance | | 87.95 |
| Remainder: | Si - 0.02, Fe - 0.30, Zn - 0.06, Sn - 0.04, Pb - 0.03, Mn - 0.04, Ag - 0.04, Mg - 0.2, P - 0.01, C - 0.005 | | 0.55 |

Representative samples of the hot rolled casting exhibited substantial porosity. After exposure to the atmosphere for four weeks, tarnishing was observed.

What is claimed:

1. An alloy which consists essentially of (a) from about 9 to about 11 percent by weight of aluminum;

(b) from about 0.75 to about 1.25 percent by weight of nickel;

(c) from about 0.01 to about 0.1 percent by weight of indium; and (d) from about 87.65 to about 90.24 percent by weight of copper.

2. A method of alloying copper, aluminum, nickel and indium to enhance the tarnish-resistance of the alloy, which comprises;

(1) providing a melt of the nickel and a portion of the copper;

(2) adding the aluminum and indium to the molten mixture of copper and nickel, said aluminum being in the form of an alloy with the remainder of the copper;

(3) thoroughly melting the mixture of (2) above;

(4) cooling the melt (3) to solidify an alloy consisting essentially of 9–11 wt.% Al, 0.75–1.25 wt.% Ni, 0.01–0.1 wt.% In and 87.64–90.24 wt.% Cu; and (5) hot-rolling the solid to reduce its thickness to from 1/7 to 1/18 of its original thickness.

* * * * *